United States Patent [19]

Donato

[11] 4,285,626

[45] Aug. 25, 1981

[54] FORK LIFT TRUCK WITH PLATE GLASS HANDLING ATTACHMENT

[75] Inventor: Guido A. Donato, Wayne, Pa.

[73] Assignee: Drexel Industries, Inc., Horsham, Pa.

[21] Appl. No.: 133,439

[22] Filed: Mar. 24, 1980

[51] Int. Cl.[3] ..... B66F 9/24; B66F 9/18

[52] U.S. Cl. ..... 414/622; 414/674

[58] Field of Search ..... 414/619–622, 414/674

[56] References Cited

U.S. PATENT DOCUMENTS

| | | | |
|---|---|---|---|
| 2,613,829 | 10/1952 | Gault | 414/622 |
| 4,243,354 | 1/1981 | Garcia | 414/622 |

*Primary Examiner*—Robert W. Saifer

*Attorney, Agent, or Firm*—Paul & Paul

[57] ABSTRACT

A fork lift truck is equipped with an attachment or fixture for handling a plate glass load. The truck is also equipped with a control system which includes sensing switch means for controlling automatically the operation of the truck to insure safe pick-up of the plate glass load. The control system also includes release switch means for preventing the truck from backing up, following deposit of a plate glass item at a storage area, until the plate glass load fixture has cleared the plate glass item.

2 Claims, 3 Drawing Figures

FORK LIFT TRUCK WITH PLATE GLASS HANDLING ATTACHMENT

BACKGROUND OF THE INVENTION

This invention relates to fork lift trucks and in particular to fork lift trucks provided with a special fixture and with control means for handling plate glass loads.

SUMMARY OF THE INVENTION

A principal object of the present invention is to adapt a standard type of fork lift truck for picking up and depositing plate glass loads.

Another object is to provide a standard type of fork lift truck with a fixture for picking up, carrying, and depositing plate glass loads, and with controls for insuring safe pick-up, carry, and deposit of such plate glass loads.

DETAILED DESCRIPTION OF THE PREFERRED EMBODIMENTS

Figure 1:
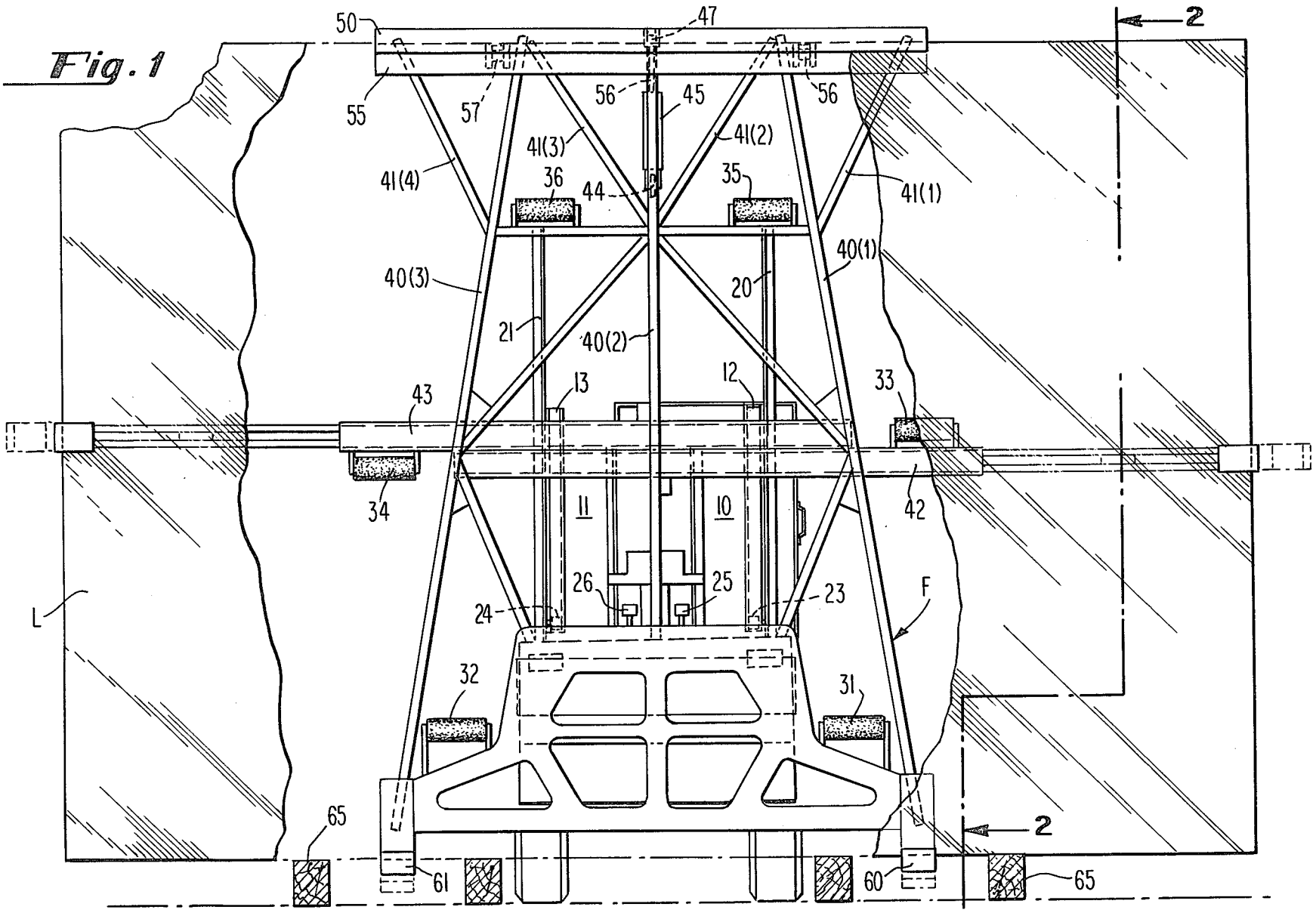
FIG. 1 is a front elevational view of a fork lift truck equipped with a plate glass handling attachment.
Figure 2:
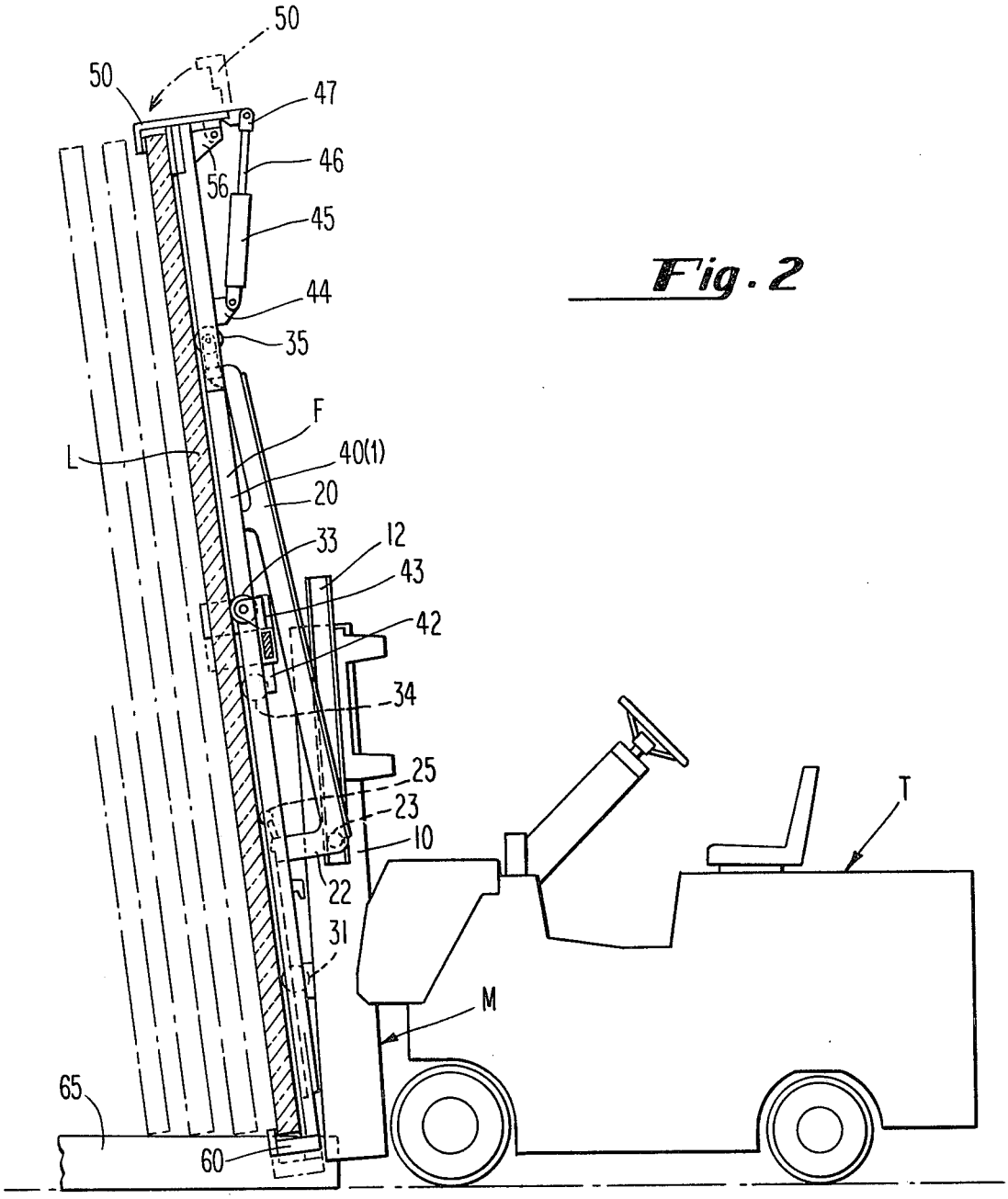
FIG. 2 is a side elevational view, looking along the line 2—2 of FIG. 1.

Referring now to FIGS. 1 and 2, there is shown a fork lift truck T having at its forward end a mast M comprising a pair of vertical support members 10 and 11 which may preferably be telescoping. Secured to the outward face of each of the mast support members 10 and 11 is a vertically disposed channel member 12,13. These channel members 12,13 support and guide a plate glass handling fixture F which includes a pair of slightly forwardly inclined but otherwise generally vertical support members 20 and 21, each of which terminates at its lower end in a forwardly extending foot portion 22. Connected to each support member 20,21, at the heel of the foot portion 22, is a roller 23,24 which is received within, and is adapted to ride up and down in, the vertical channel members 12,13.

Secured to the upper and lower ends of support members 20,21 and forming a part of the plate glass handling fixture F, is a frame structure which includes a cross frame member 27 and vertical frame members 40(1), 40(2) and 40(3), seen best in FIG. 1. Supported transversely across the top of the frame members 40(1) 40(2) and 40(3) is a cross beam 55 and, assisting in supporting cross beam 55, are auxiliary frame members 41(1), 41(2), 41(3) and 41(4), seen clearly in FIG. 1.

Supported in brackets on plate glass handling fixture F are a pair of upper nylon rollers 35,36, a pair of middle nylon rollers 33,34, and a pair of lower nylon rollers 31,32. The plate glass load L is adapted to rest against these six nylon rollers when the load is on the truck. The rollers allow for relative motion in the vertical direction between the plate glass load L and the fixture F.

At the storage area, a plurality of plate glass items are supported on a series of storage rails 65. Each individual plate glass item is spaced from its neighbor by suitable means, such as by horizontally disposed spacing strips (not shown).

Supported on the plate glass handling fixture F are two lightly spring-loaded feeler rollers 25,26 which in normal biased position project forwardly from the fixture F in such position as to be the first to contact the plate glass item as the fork lift truck approaches the storage area.

OPERATION

The operation of the fork lift truck T will now be described with reference to FIGS. 1, 2 and 3. Assume that the operator or driver has been given instructions to remove a plate glass item from the storage area. When the driver sits down on the seat of truck T, the drive control circuit seat switch 72 (FIG. 3) closes, and since switch 70 is in the "A" position, the circuit from the battery is completed and the truck may be driven in either the forward or reverse directions.

Assume that the truck is driven toward the plate glass storage area. As the truck approaches the nearest plate glass load L, the two lightly spring-loaded feeler rollers 25,26 come into contact with the surface of the plate glass load and are caused to move rearwardly. This causes the double-pole double-throw switch 70 to move from position "A" to position "B". As a result, the power circuit to the truck drive through the closed seat switch 72 is interrupted and the parking brake 98 is applied. Parking brake 98 is applied because, when switch 70 moves to position "B", a circuit is completed through the normally-closed switch 80, the normally-closed switch 90 in position B, and the coil 96 of solenoid valve 95. Solenoid valve 95 becomes energized and hydraulic fluid is applied through the three-way normally-closed solenoid valve 95 to the brake cylinder 97, which operates to apply the parking brake 98.

Using control lever 100, which controls the mast-lift cylinder 83 by way of the normally-open solenoid valve 82, the driver next elevates the mast M to elevate the plate glass handling fixture F from the lower position shown in phantom in FIGS. 1 and 2, to the raised position shown in solid lines. Switches 75 and 85 are mounted on fixture F and when fixture F is moved upwardly or downwardly these switches 75 and 85 move with the fixture.

When fixture F is moved upwardly, as just described, the lower end of fixture F captures the lower end of the plate glass load L. As mentioned above, when fixture F moves upward, the double-pole double-throw switch 75 is carried with it and the arm of the switch 75 contacts the lower edge of the plate glass item L which is resting on the storage rails 65. As a result, the switch arm of switch 75 is moved downwardly from position "A" to position 37 B", thereby reestablishing the truck drive circuit through the closed seat switch 72 which had been interrupted at switch 70 when the contacts of switch 70 moved from position A to position B. The parking brake 98 remains, however, in applied position, since switch 70 remains in position B.

Figure 3:
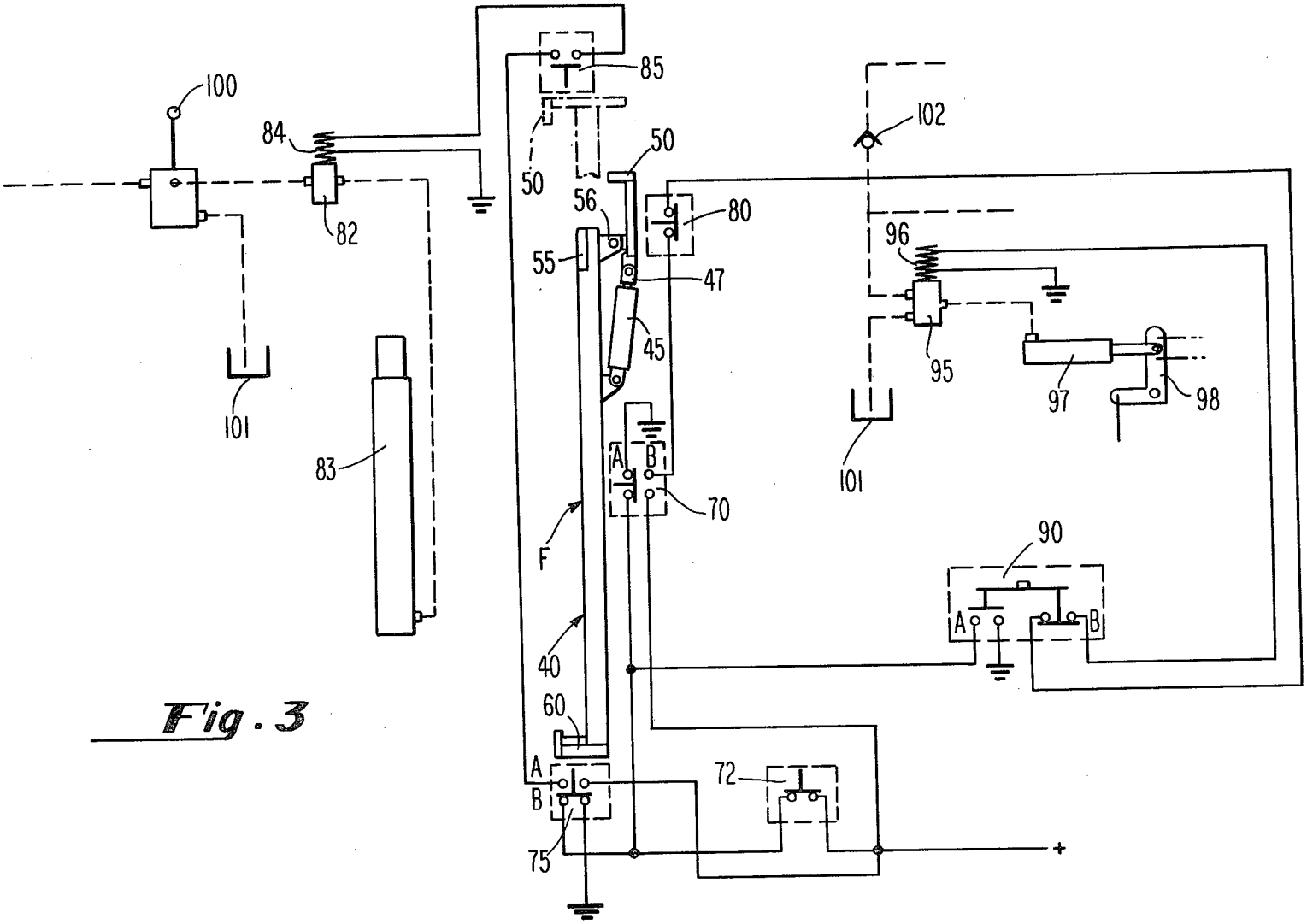
FIG. 3 is a schematic diagram of a control circuit suitable for use in controlling automatically the handling of the plate glass load by the fork lift truck of FIGS. 1–2.

The driver next actuates cylinder 45 to extend piston 46 to move the attachment retaining head 50 from the open position shown in solid line in FIG. 3 to the closed position shown in phantom in FIG. 3 and in solid line in FIG. 2. This captures the upper edge portion of the plate glass load L. Closing of the attachment-retaining head 50 opens the normally-closed switch 80. This interrupts the brake circuit through the solenoid valve coil 96 and de-energizes the solenoid valve 95. This cuts the fluid pressure to brake cylinder 97, and releases the parking brake 98.

The normally-open two-way solenoid valve 82 in the mast-control circuit remains open, since the circuit to its coil 84 is open at position "A" of switch 75 and also at switch 85 which is in its normally-open position. Thus, the hydraulic circuit to the mast-lift cylinder 83 remains completed through solenoid valve 82 and the driver has control of the lifting and lowering of mast M by his control of the mast-lift cylinder 83 through control lever 100.

The operator now places the truck directional control selector (not shown) in the reverse drive position and backs the fork lift truck T away from the storage load, carrying the captured plate glass load L with him.

Assume now that a plate glass load is on the fork lift truck T, and that the operator or driver wishes to deposit the load on the storage rails 65 at the storage area. When the truck arrives at the storage area, the operator, using lever 100, lowers the plate glass load by lowering the mast M under the control of mast lift cylinder 83. When the lower edge of the plate glass load engages the storage rails 65 the downward movement of the plate glass load is stopped but the downward movement of fixture F continues, and, as a result, relative motion occurs between the plate load and the plate glass handling fixture F. This relative movement of the plate is carried on the nylon rollers 31-36 which roll on their respective axes.

Downward movement of fixture F carries switches 75 and 85 downward relative to the plate glass load L. As lowering of fixture F continues, the depressed arm of lower switch 75 becomes disengaged from the lower edge of the plate glass load L and the switch arm of switch 75 moves back up to its normal position A. As fixture F is further lowered, the arm of upper switch 85 contacts the upper edge of the plate glass load L and the arm of switch 85 is moved from open to closed position. When this occurs, the mast-control circuit through switch 75, switch 85, and coil 84 is completed, coil 84 becomes energized, and the normally-open solenoid valve 82 closes. This shuts off the hydraulic circuit to the mast lift cylinder 83 and prevents further lowering of the mast. The plate glass load L is now resting on the storage rails 65.

The operator now opens the attachment retaining head 50 by the actuating cylinder 45. When this is done, switch 80 in the brake circuit moves from open to closed position and switch 85 in the mast circuit moves from closed to open position. Movement of switch 80 to closed position completes the brake control circuit through coil 96 and, as a result, the parking brake 98 is applied. Movement of switch 85 in the mast-control circuit from closed to open position interrupts the electrical circuit through coil 84 of solenoid valve 82, and valve 82 becomes de-energized and returns to its normally-open position. This returns control of the mast M to the operator, by allowing control lever 100 to control the mast cylinder 83. This permits full lowering of the fixture F so that its lower end will clear the plate glass load L, which is now resting on storage rails 65.

Since the plate glass load L is still leaning against the spring-loaded feeler fingers 25,26 the arm of switch 70 is still in position B and parking brake 98 is still ON.

To back the truck T away from the load L, which is now resting on storage rails 65, the operator momentarily depresses switch 90. This closes switch 90 at position "A" and opens it at position "B". This closes a truck drive circuit through the drive control seat switch 72, and opens the brake-control circuit through coil 96 of the normally-closed solenoid valve 95. This shuts off fluid pressure to brake cylinder 97 and releases the parking brake 98. This allows the operator to back the truck T away from the load. Once the attachment fixture F is free of the load L, feeler fingers 25,26 move to their biased forward position and, as a result, switch 70 moves from position "B" to position "A", thereby locking up the drive control circuit in completed circuit condition and permitting the operator to release switch 90.

What is claimed is:

1. A fork lift truck having a truck drive-control circuit, a parking-brake control circuit, an elevatable mast-control circuit, and plate glass handling means, said plate glass handling means and control circuitry including:

a. a plate glass handling fixture supported on said mast;

b. said fixture having means at its upper and lower ends for capturing the upper and lower edge portions of a plate glass load;

c. said upper capture means being movable pivotally between open and closed positions;

d. spring-loaded feeler means supported on said fixture and adapted to be actuated by a plate glass load;

e. switch means responsive to actuation of said feeler means for opening said drive-control circuit to disable said drive and for completing said parking-brake control circuit to apply said parking brake;

f. means, operable after said fixture has been raised sufficiently to capture the lower edge portion of a plate glass load, for closing said drive-control circuit to reestablish said drive;

g. means for moving said pivotal upper capture means to closed position to capture the upper edge portion of said plate glass load; and h. means, responsive to the closing of said upper capture means, for opening said brake-control circuit to release said parking brake.

2. A fork lift truck according to claim 1 which includes:

a. means for lowering said fixture sufficiently to deposit said load onto storage rails;

b. switch means for opening said drive-control circuit to disable said drive after the captured lower edge portion of said plate glass load has been released by further lowering of said fixture;

c. switch means responsive to a further lowered position of said fixture for disabling the mast control circuit;

d. means for opening said upper capture means to release the upper edge portion of said load and to close the parking brake control circuit to apply the parking brake;

e. manually operable switch means for momentarily opening the parking brake circuit to release said parking brake and for completing the drive circuit to allow said truck to be backed away from the deposited load, whereby said spring-loaded feeler fingers return to their biased position and in so doing operate said responsive switch means to hold said drive circuit in closed condition and to maintain said parking brake circuit in open released position.

* * * * *